US006764024B2

(12) United States Patent
Crampton

(10) Patent No.: US 6,764,024 B2
(45) Date of Patent: Jul. 20, 2004

(54) ROTARY FOAM NOZZLE

(75) Inventor: George Crampton, Carp (CA)

(73) Assignee: National Research Council of Canada, Ottawa (CA)

( * ) Notice: Subject to any disclaimer, the term of this patent is extended or adjusted under 35 U.S.C. 154(b) by 168 days.

(21) Appl. No.: 09/987,537

(22) Filed: Nov. 15, 2001

(65) Prior Publication Data

US 2002/0027171 A1 Mar. 7, 2002

Related U.S. Application Data

(63) Continuation-in-part of application No. 09/515,091, filed on Feb. 29, 2000, now Pat. No. 6,328,225.

(51) Int. Cl.[7] ..... B05B 3/00; B05B 3/06

(52) U.S. Cl. ..... 239/246; 239/251; 239/225.1; 239/248

(58) Field of Search ..... 239/246, 251, 239/225.1, 237, 240, 248, 263, 538, 548, 249, 558

(56) References Cited

U.S. PATENT DOCUMENTS

| | | | | |
|---|---|---|---|---|
| 2,004,840 A | | 6/1935 | Suchtelen | 159/4.2 |
| 3,393,745 A | | 7/1968 | Durstewitz | 169/15 |
| 4,463,583 A | | 8/1984 | Kruger et al. | 68/205 R |
| 4,519,423 A | * | 5/1985 | Ho et al. | 137/888 |
| 4,830,790 A | | 5/1989 | Stevenson | 261/18.1 |
| 5,024,382 A | * | 6/1991 | Shook et al. | 239/11 |
| 5,441,113 A | | 8/1995 | Pierce | 169/5 |
| 5,452,856 A | * | 9/1995 | Pritchard | 239/297 |
| 5,617,886 A | * | 4/1997 | Mathieus | 134/172 |
| 5,753,301 A | * | 5/1998 | Brytsche et al. | 427/162 |
| 6,189,622 B1 | | 2/2001 | Audet et al. | 169/37 |

OTHER PUBLICATIONS

Kim, Andrew; An Effective Compressed–Air–Foam Fire–Suppression System; Canadian Consulting Engineer; Mar. 1997; p. 32.

Kim, Andrew et al.; Performance of Class A Compressed–Air–Foam From a Fixed System; Proceedings from International Fire Foam Symposium and Workshop; Thunder Bay, Ontario; May 3–5, 1994; p. 26.

Kim, Andrew et al.; A Newly–Developed Fixed Pipe Compressed Air Foam Fire Suppression System; Proceedings of Fire Suppression and Detection Research Application Symposium; Orlando, Florida USA, Feb. 2, 1999; pp. 329–339 (NRCC–43387).

* cited by examiner

*Primary Examiner*—Davis Hwu
(74) *Attorney, Agent, or Firm*—J. Wayne Anderson

(57) ABSTRACT

A rotary nozzle for compressed air foam (CAF) has a barrel mounted for rotation about an axis perpendicular to its longitudinal axis. The barrel is mounted to a CAF supply conduit and has a cross-sectional area substantially larger than the cross-sectional area of the conduit. Two non-equal orifices in the barrel, located on the opposite sides of the axis of rotation, distribute CAF such that it covers an almost complete, typically a circular area on the ground.

23 Claims, 10 Drawing Sheets

ROTARY FOAM NOZZLE

This application is a Continuation-In-Part of U.S. patent application Ser. No. 09/515,091 filed on Feb. 29, 2000 now U.S. Pat. No. 6,328,225.

BACKGROUND OF THE INVENTION

This invention relates to nozzles, and more particularly to a rotary nozzle suitable for distributing a stream of fire-extinguishing compressed-air foam, sufficient to extinguish or control a fire in the path of the foam stream.

In the art of firefighting, it is known to use foam produced from a solution of a foam concentrate in water. The volume of the solution is expanded by the addition of air and mechanical energy to form a bubble. structure resembling shaving cream. The bubble suffocates and cools the fire and protects adjacent structures from exposure to radiant heat. Foam is well known of being very efficient on fire fed from a liquid (oil or chemicals).

Foam can be generated using an air-aspirating nozzle, which entrains air into the solution and agitates the mixture producing bubbles of non-uniform size. With an aspirating system, the foam is formed at the nozzle using the energy of the solution stream.

Foam can also be generated by injecting air under pressure into the solution stream. The solution and air mixture are scrubbed by the hose (or pipe) to form a foam of uniform bubble size. The energy used in this system comes from the solution stream and the air injection stream. This system produces a so-called "compressed-air foam" (CAF) which is capable of delivering the foam with a greater force than a comparable aspirated system described above. Foam generation for fixed pipe system is documented in the proceedings from the "Fire Suppression and Detection Research Application Symposium" entitled "A Newly-Developed Fixed Pipe Compressed Air Foam Suppression System" by Andrew K. Kim and George P. Crampton. This document is herein incorporated by reference.

When delivered from a hose, CAF is ejected as a "rope" of foam with a high forward momentum through a smooth bore nozzle. An attempt to widen the delivery angle using a conventional nozzle (such as e.g. a water sprinkler) results in collapsing the bubble structure of the foam and degenerating the foam back into a solution and air.

A published Canadian patent application No. 2,131,109 describes a foam nozzle having a stationary barrel and a rotary distributor with three tubular angled outlets. The design of the nozzle is such that the combined cross-sectional areas of the outlets are not less than the cross-sectional area of the barrel and not larger than twice the cross-sectional area of the barrel.

While the nozzle of the above application is useful, there is still need for a nozzle affording higher efficiency, lower profile, larger ground coverage and a more reliable rotational arrangement or bearing.

SUMMARY OF THE INVENTION

The present invention achieves the distribution of a stream of fire-extinguishing compressed-air-foam in large circle area by using a nozzle comprising:

a supply tubing for supplying foam from a supply conduit, having a longitudinal axis;

a barrel being rotatably attached to the supply tubing and defining a passageway therein, the passageway of the barrel being at angle to the longitudinal axis of the supply tubing;

the barrel having at least one orifice which, upon forced flow of the foam, delivers a stream of the foam along a trajectory having a component that is tangential to a circular path coaxial with the longitudinal axis of the supply tubing such as to cause a rotational movement of the barrel;

the sum of all the cross-sectional areas of the at least one orifice is not less than ½ of the cross-section of the supply conduit.

The distribution of a stream of fire-extinguishing compressed-air-foam in large circle area can also be achieve by using a nozzle comprising:

a supply conduit for supplying foam having a longitudinal axis and a central enlarged portion;

a diffuser in flow continuity with the supply conduit having curved cross-section;

an impeller which rotates, upon forced flow of the foam, to drive an input shaft of a reducer;

an output shaft of the reducer drives the diffuser to impart a rotational movement, therefore delivering a stream of foam in a circular path coaxial with the longitudinal axis.

The present invention provides a simplified nozzle structure allowing for durability and readiness for sporadic uses.

The nature and objects of the invention and the various advantageous features are shown in the accompanying drawings illustrating preferred forms by way of examples.

DETAILED DESCRIPTION OF THE INVENTION

Figure 1:
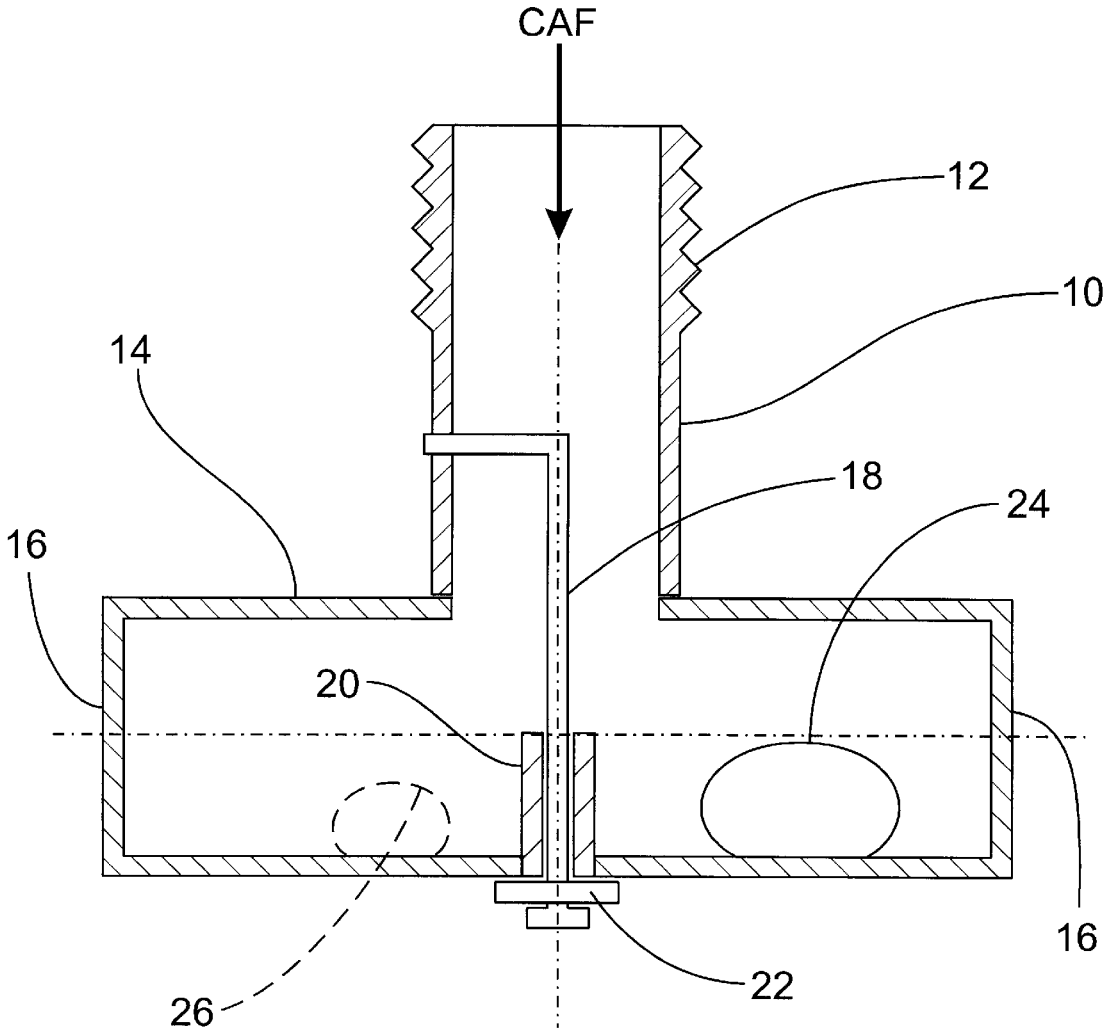
FIG. 1 is a schematic cross-sectional view of an embodiment of the nozzle of the invention, with the orifices directed downwards.

FIG. 1 shows a typical compressed-air foam nozzle of the invention. The nozzle has a supply tubing 10 which has a thread 12 for connecting the nozzle to a foam solution supply conduit from a supply system, not shown. A tubular barrel 14 with sealed ends 16 is mounted rotatably to the tubing 10 by means of a spindle 18 which is attached or fastened to the tubing 10. The vertical section of the spindle 18 as illustrated defines the axis of rotation. A loose-fit bearing sleeve 20 or an equivalent bearing is provided on the spindle 18 to facilitate the rotation. A washer 22 is mounted at the passage of the spindle 18 through the sleeve 20 to reduce leaks and provide a thrust-bearing surface.

In the first embodiment illustrated, the barrel is disposed for rotation around a vertical axis, but can of course be installed such that the axis of rotation is at an angle to vertical.

Preferably, the cross-sectional area of the barrel 14 is between 150% and 300% of the cross-sectional area of the tubing 10. The relatively larger size of the barrel is intended to provide some manifold pressure to balance the delivery of foam from each side of the vertical axis of rotation. The size of the barrel is limited by its mass (too heavy a barrel would not function properly), therefore it is advantageous to design the barrel from a relatively light material e.g. an aluminum alloy. Also, the quality of the bearing plays an important role.

Two orifices 24, 26 are provided in the lower part of the barrel. The orifice 24 as illustrated is positioned in front of the barrel while the smaller orifice 26, represented in phantom lines, is disposed in the rear of the barrel. The orifices are positioned off-center (i.e. off the vertical plane of symmetry of the barrel). The orifices are also disposed on the opposite side of the vertical symmetry plane of the barrel. This arrangement results, when a stream of fluid is delivered in operation to the barrel through the tubing 10, in jets of the fluid being ejected downwardly and tangentially to the axis of rotation of the barrel 14 thus causing a rotation of the barrel about the axis In the first embodiment illustrated, the orifices are of non-equal size and are spaced non-symmetrically relative to the axis of rotation. This is dictated by the need to balance the forces acting on the barrel due to the flow of the fluid through the barrel and its orifices.

Figure 2:
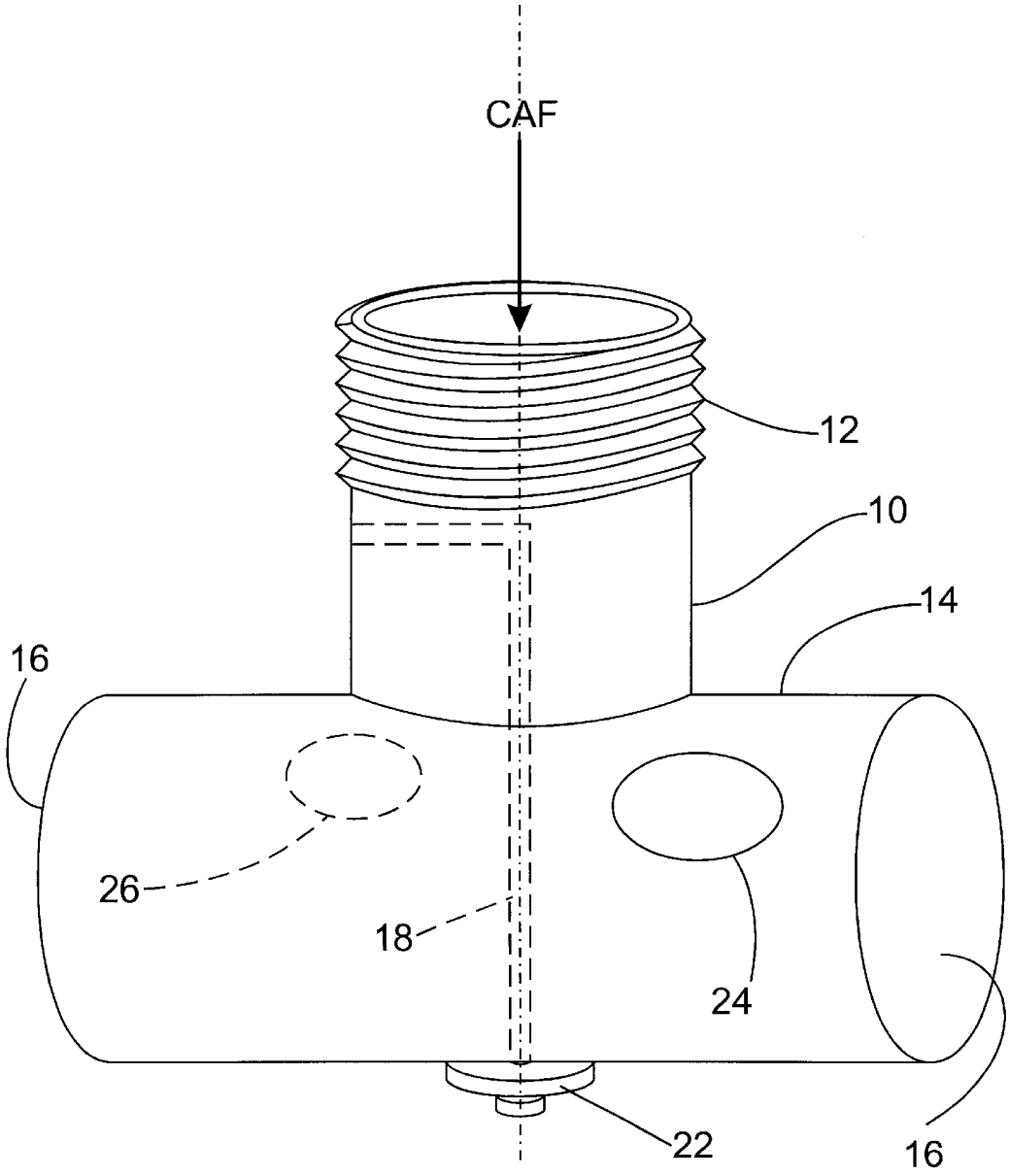
FIG. 2 is a side view of second embodiment of the invention, with the orifices pointing upwards.

As shown in the second embodiment in FIG. 2, the orifices can be located in an upper region of the barrel, above its mid-line. Again, the smaller orifice 26 is disposed in the back of the barrel 14 while the orifice 24 is disposed in the front of the barrel as illustrated. Such arrangement would result in the CAF being distributed e.g. toward the ceiling above the nozzle level.

Figure 3:
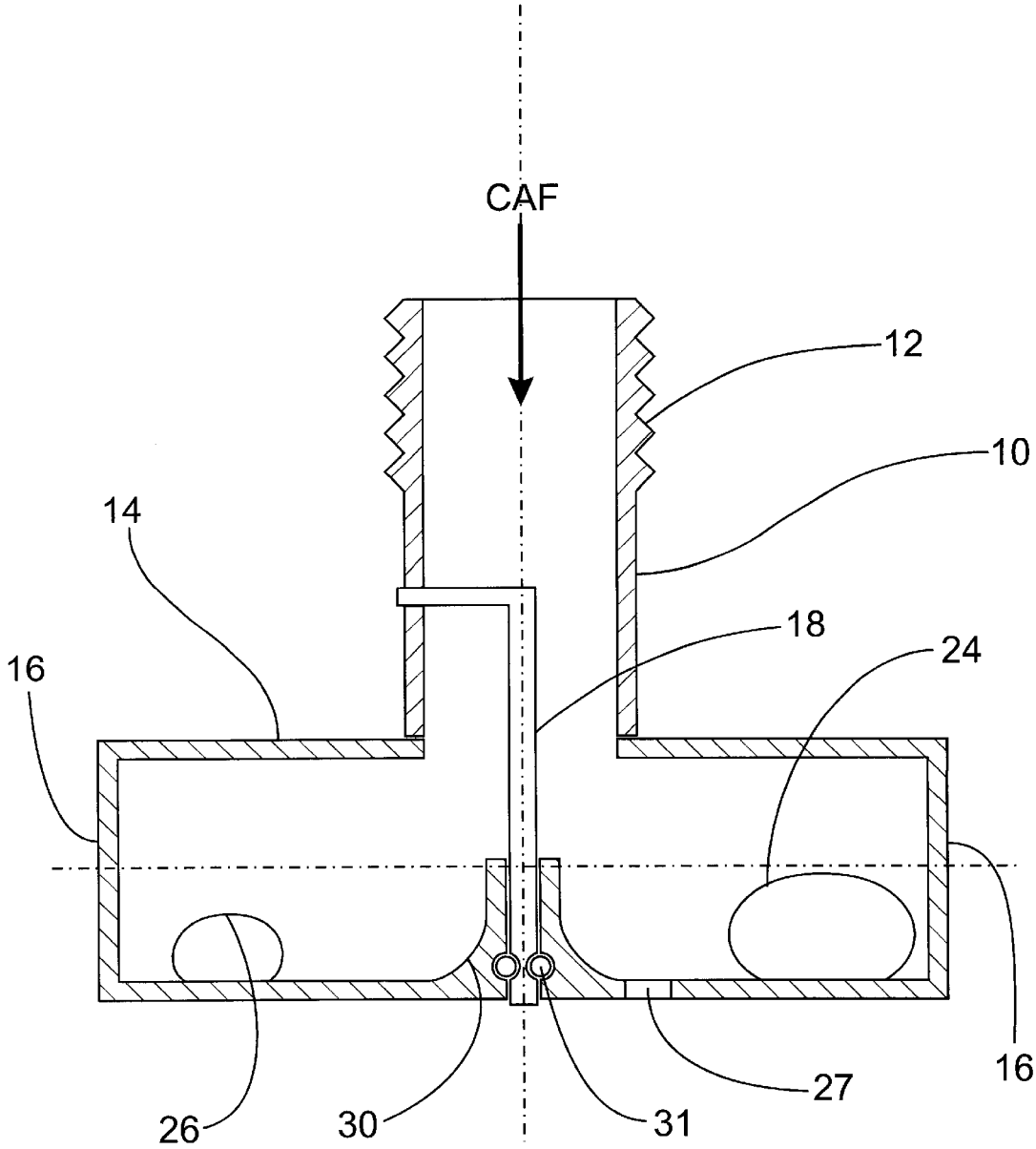
FIG. 3 is a schematic cross-sectional view of a third embodiment of the nozzle of the invention, having a central bearing and a supplemental close range orifice.

Alternatively, as shown in the third embodiment in FIG. 3, the orifices 24, 26 can also be located in front of the barrel 14. The large orifice 24 causes the rotation of the barrel 14, while the small orifice 26 counter-react by slowing the rotation. This is efficient to deliver a large amount of foam, while keeping a controlled nozzle rotation. There is the possibility to add an orifice 27 at the bottom of the barrel 14 near the bearing 31 to deliver foam near the axis of rotation of the barrel. To assist laminar flow of foam in the barrel, a slope or a rounded surface portion 30 can be added near the bearing 31. In this embodiment, the sleeve bearing 20 (FIG. 1) is replaced by a ball bearing assembly 31. This ball bearing assembly can be integral to the barrel 14 and the spindle 18, such as shown on FIG. 3 or a separate unit (not shown).

In operation, a compressed air foam, known in the art, is passed to the barrel through the tubing 10. The foam fills the barrel and is ejected by the orifices in two separate streams without being substantially degenerated into a foam solution and air. The tangential flow of the foam causes the barrel 14 to rotate. One of the streams forms an annular pattern at the target below the nozzle (in the embodiment of FIG. 1) or above the nozzle (as per FIG. 2), and the other stream forms a second annular or circular pattern. The size and position of the orifices can be selected such as to fill a desired target area with the foam.

Figure 4:
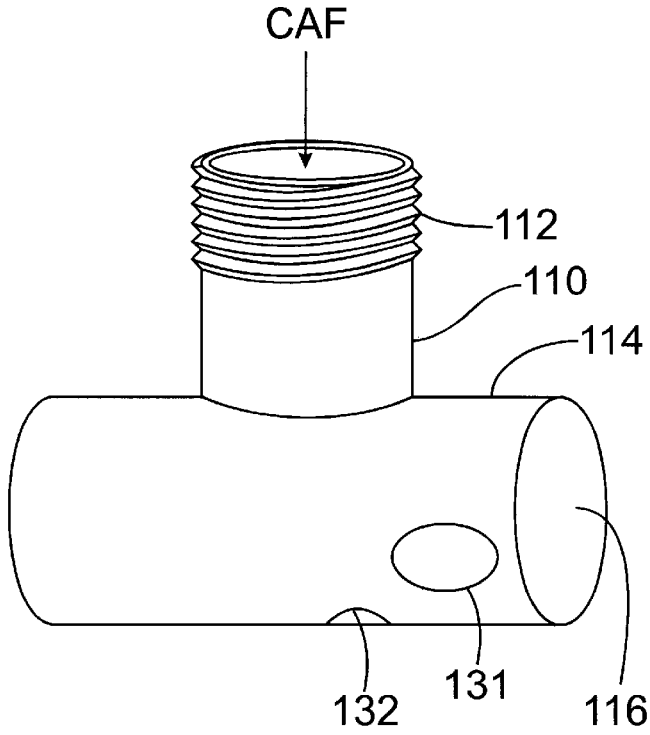
FIG. 4 is a side view of a forth embodiment of the nozzle of the invention with close and far delivery orifices.
Figure 5:
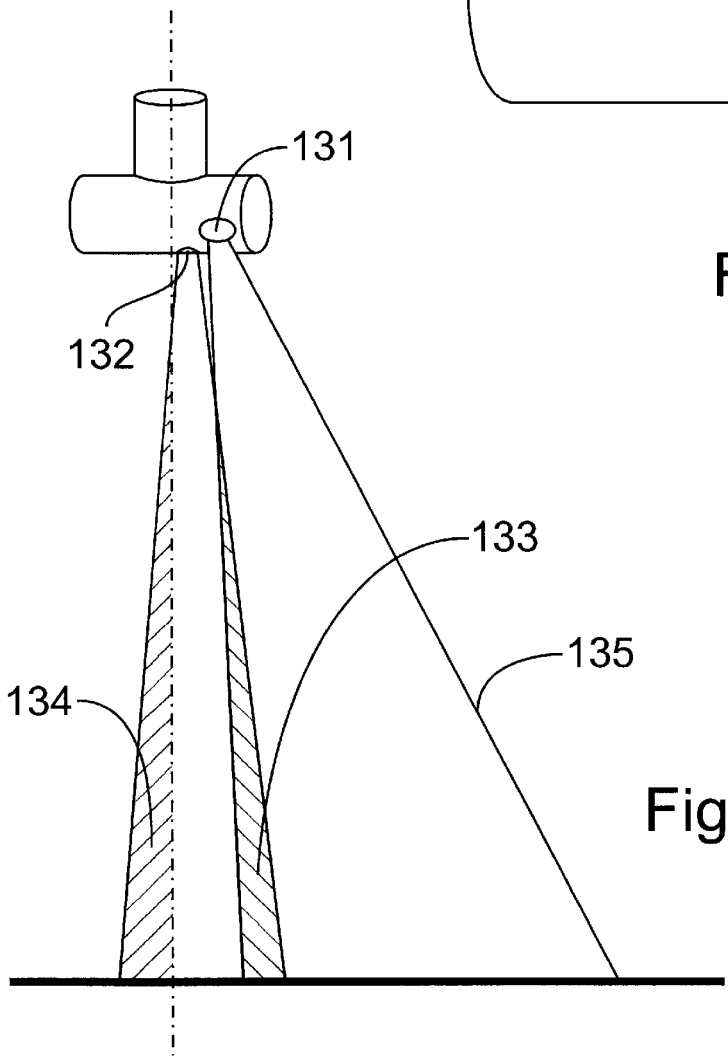
FIG. 5 is a side view of the forth embodiment of the nozzle of the invention showing the projection of each orifice.

Referring to FIG. 4, a forth embodiment of the nozzle provides a high ceiling room version. The barrel 114 has a distal orifice 131 and a proximal orifice 132 preferably on the same side of the barrel 114. The distal orifice 131, being close to one end 116 of the barrel, projects downwardly, tangentially to the axis of rotation of the barrel, and away from this same axis. The proximal orifice 132 projects close to the axis of rotation of the barrel. FIG. 5 illustrates the typical projection for each orifice. Some overlaps 133, 134 assure a full coverage in the area (full circle) defined by the external projection 135 of the proximal orifice 132.

Figure 6:
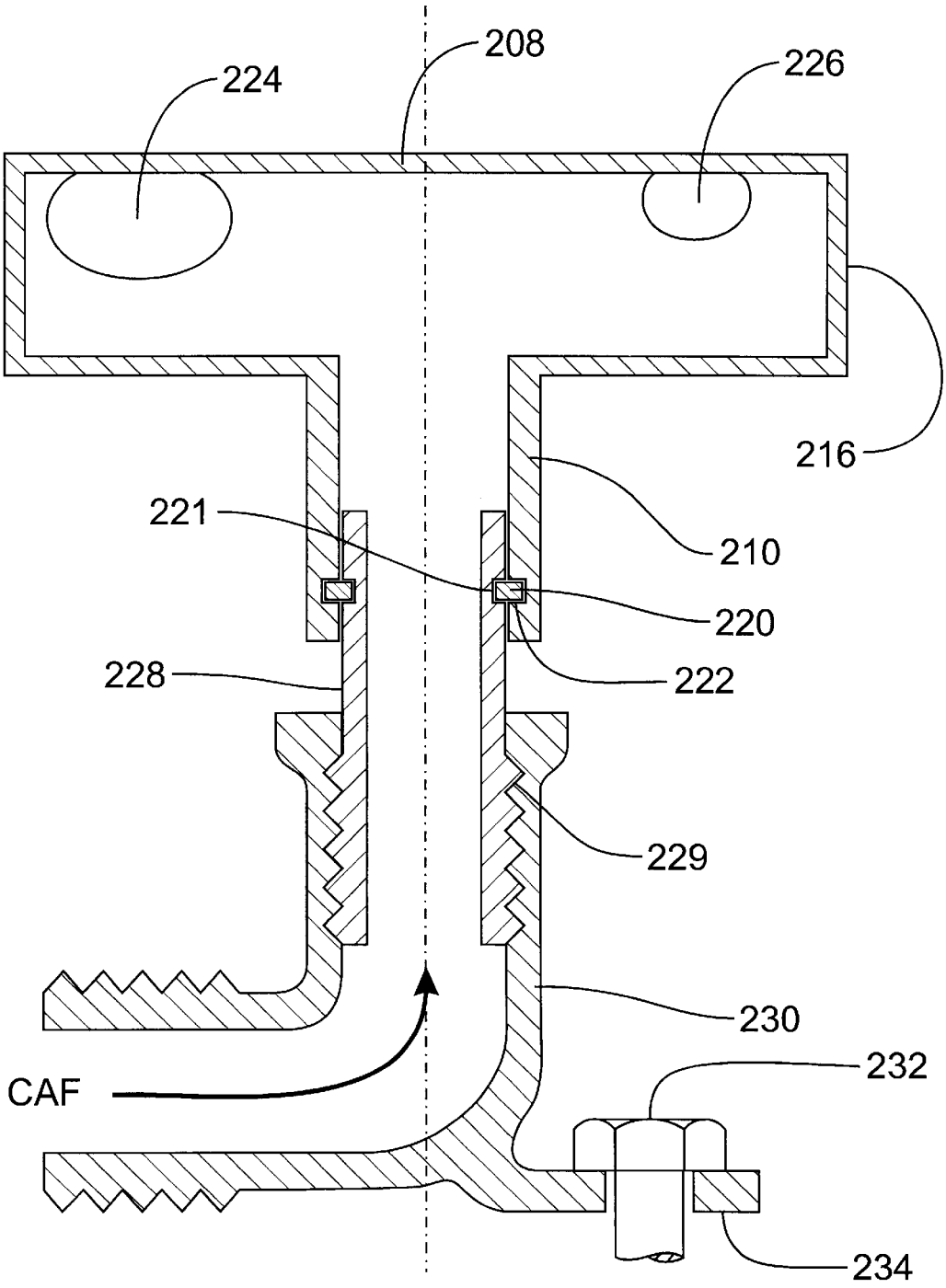
FIG. 6 is a schematic cross-section view of a fifth embodiment of the nozzle of the invention for projection from the floor.

Referring to FIG. 6, a fifth embodiment of the nozzle provides a moveable floor unit. This unit can be used in situation where surface to be protected are not accessible from the ceiling, such as a floor area under the wings of an aircraft, in a hangar or outside near a docking/fueling station. The barrel 216 has an overall T shape with a head portion 208 and a tubing portion 210. The tubing portion 210 is cylindrical and arranged to be coaxially fitted over an adaptor 228. A ring 220 or a cir-clip cooperates with grooves 221, 222 in respectively, the tubing portion 210 of the barrel and the adaptor 228, to rotatably join the barrel and the adaptor.

The head 208 of the barrel 216 has orifices, which can be arranged as in the preceding embodiments. In the example, a large orifice 224 projects upwardly and tangentially to the axis of rotation of the barrel, using the pressure of the CAF. A smaller orifice 226 projects upwardly and tangentially closer to the axis of rotation of the barrel than the large orifice 224 such as in the third embodiment, to slow down the velocity of rotation of the nozzle. The adaptor 228 has a threaded portion 229, which can have different depths and pitches, to match different type of piping. Preferably, these pipes are dimensioned for CAF. The coupling 230 connecting with the adaptor can have an attachment prong 234 to secure the nozzle, for example with a bolt 232 to a fixed structure, or to a weight to stabilize the nozzle when it is needed to be moved.

Figures 7, 8:
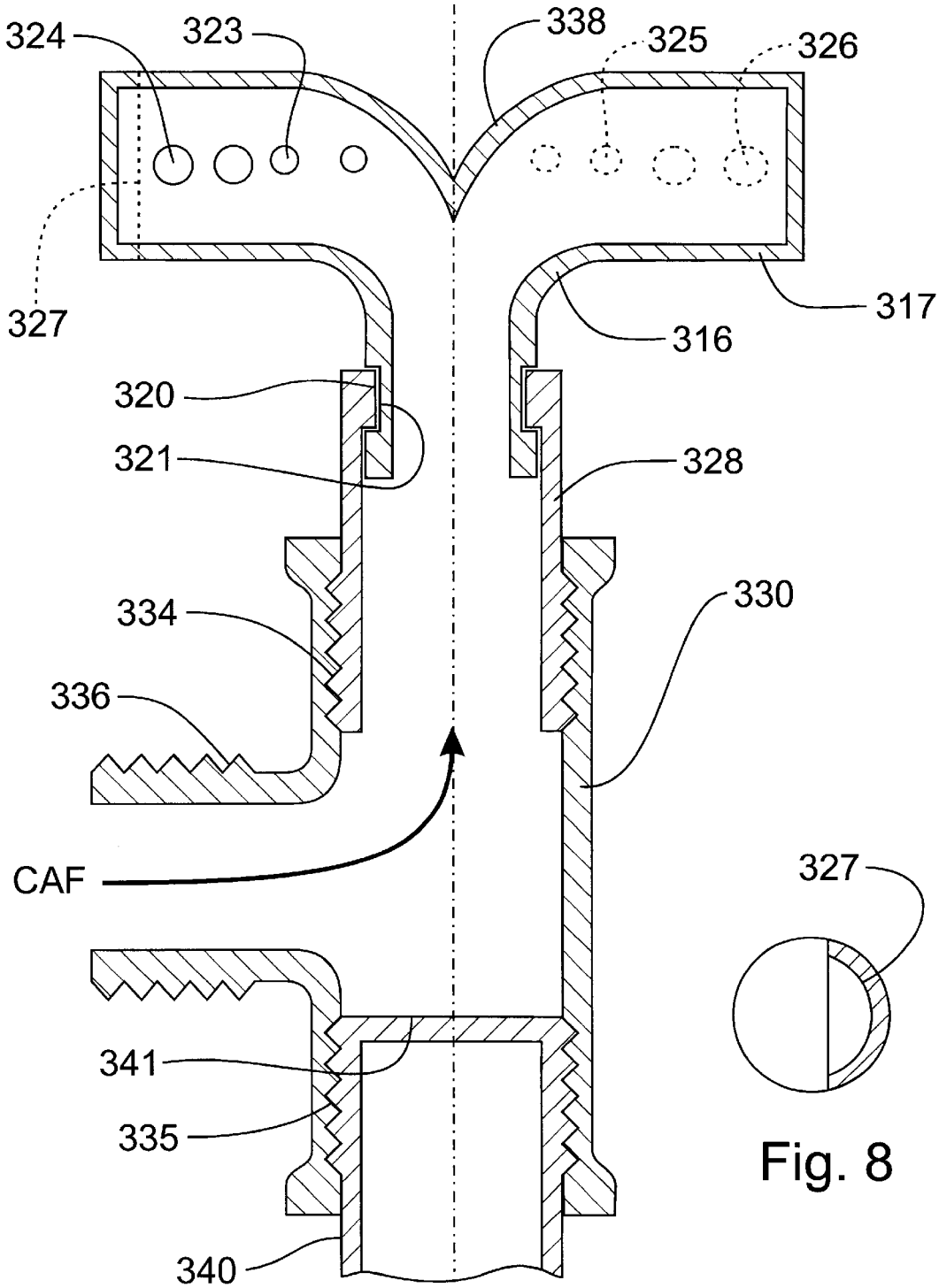
FIG. 7 is a schematic cross-section view of a sixth embodiment of the nozzle of the invention for projection from the floor and having a deflecting portion.
FIG. 8 is a side view of a detail of the head of the sixth embodiment of the nozzle of the invention.

Referring to FIG. 7, a sixth embodiment of the nozzle provides another moveable floor unit. The barrel 316 has deflectors 338 to assist laminar flow of foam in the barrel, and to divide the flow in each upper branch 317 of the barrel 316. This results in an overall "Y" barrel shape, with the orifices 323 to 326 located in the two upper branches 317 of the "Y". The orifices are scattered in the branches and can have different diameters. Preferably, the larger orifices 324, 326 are located at the extremities of the branches and the smaller orifices 323, 325 are located closer to the nozzle's axis of rotation. This ensures balanced foam dispersion. A truncation 327, at the tip of at least one of the branches, can be added to provide foam delivery for region far from the nozzle, and usually out the other orifices projection. FIG. 8 shows a side view of one branch, having such a truncation 327. The upper branches are separated by slopes or rounded surfaces 338 diverging from a point close or on the nozzle's axis of rotation. The rotation movement of the barrel is provided by the cooperation of a groove 321 in the lower branch of the barrel, with a ring 320 integral with an adaptor 328. The groove 321 and the ring 320 are loose fitted to minimize the friction during rotation. There is no need for tight sealing between these members since foam has low density, minimizing the lost through interstices. In the example, the barrel 316 is adapted to be fitted inside the adaptor 328, but it is also possible to have the adaptor 328 adapted to fit inside the barrel 316.

Such as in the previous embodiment, the adaptor 328 can be threaded to match different type of piping. In the example, a T shaped coupling 330 connects with the adaptor 328. The coupling 330 has two female threads 334, 335 along the nozzle's axis of rotation, and a male thread 336 perpendicular to this same axis. The adaptor 328 is fastened to the upper female thread 334 and a support element 340, having a surface 341 to block the flow, is fastened to the lower female thread 335.

Figure 9:
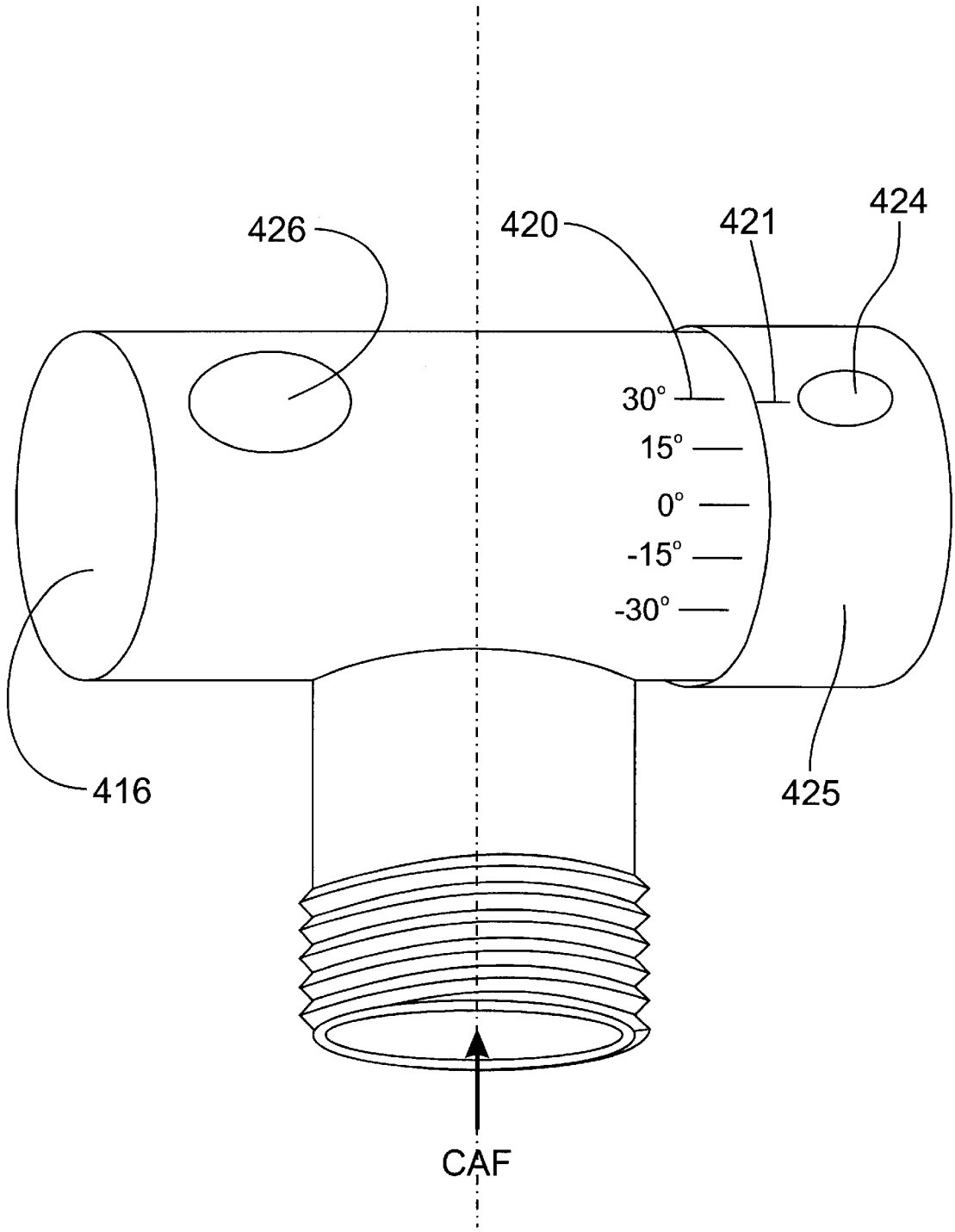
FIG. 9 is a side view of a seventh embodiment of the nozzle of the invention specially adapted as a mobile fire-fighting equipment.

Referring to FIG. 9, a seventh embodiment of the nozzle provides an adjustable orifice 424. The barrel 416 can be mounted with a spindle and bearing, such as in the first to fourth embodiments, or with grooves and ring, such as in the fifth and sixth embodiments. A fixed orifice 426 is at a defined location on the barrel 416, while the adjustable orifice 424 is located on an adjustment cylinder 425 concentric with the barrel 416. Usually, the fixed orifice 426 and the adjustable orifice 424 are located on opposite sides on the barrel 416, but it is possible to have a plurality of adjustable orifices 424 on opposite sides of the barrel or on the same side, in combination with one or more fixed orifices 426. Indicator lines 420 with inscriptions, such as angles or other instructions, cooperating with a line on the adjustment cylinder 425, inform the operator about the location of the adjustable orifice(s) 424.

This last embodiment is directed for firefighters, or in situations where the nozzles are accessible by restricted or trained personnel. It is not desirable to use this type of nozzle in fixed construction where an incorrect adjustment can result in an improper foam delivery to the surface to be protected. Firefighters can use such a nozzle in combination with their lance, or the nozzle can be mounted directly on the lance. Then a firefighter can adjust an, or several orifices in view of the area to be covered with foam. This type of nozzle can also be used in technical or electrical rooms, where specific areas or equipment need to be protected.

In the first to the seventh embodiments, the orifices can be of various shapes—round, oval, triangular, provided that the sum of the cross-sectional areas of these orifices is not less than ½ or greater than twice the cross sectional area of the supply conduit. Preferably, the sum of all the cross-sectional areas of all these orifices is not less than ¾ or greater than one and a half of the cross-section of the supply conduit. At this minimal ratio some portion of the foam can collapse but the foam still maintain enough consistency for its purpose. Below this ration, too much foam collapse is observed to achieve the desired result. Over the maximal ratio, the rotational speed decreases to a level where the foam is delivered to a very limited area.

Figure 10:
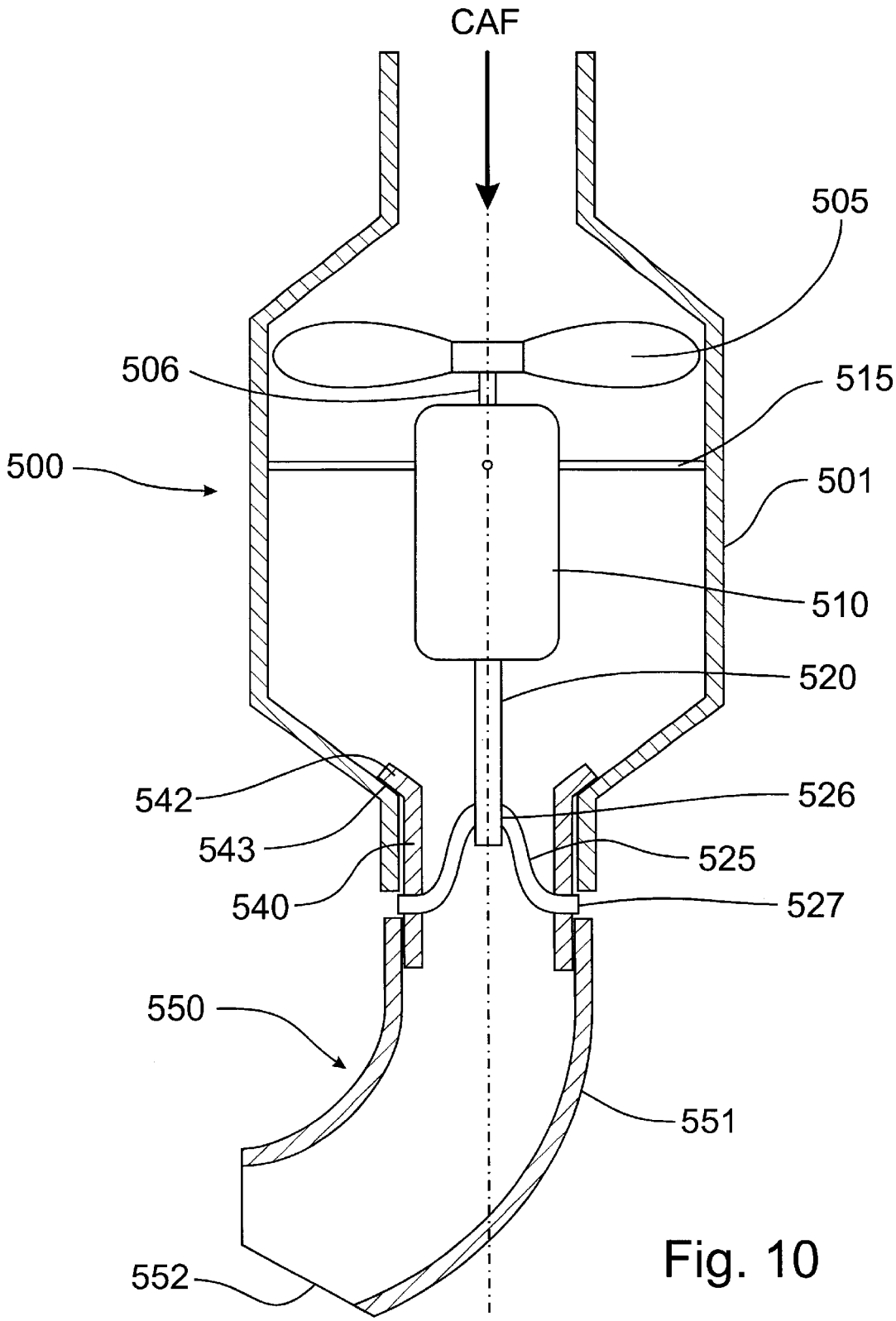
FIG. 10 is a schematic cross-section of a eighth embodiment of the nozzle of the invention having a gear box controlling the projection outlet.

Referring to FIG. 10, a eighth embodiment provides a nozzle having an outlet assembly 550 rotated by a geared speed reducer 510 driven by an impeller 505. The cylindrical body 500 of the nozzle is a tube having a nominal internal diameter and an enlarged diameter central portion 501. The cylindrical body 500 has a longitudinal axis which coincides with the axis of rotation of all the rotating parts of the nozzle. The internal diameter of the central portion 501 is slightly larger than the overall length of an impeller 505. The impeller 505 is centered on an impeller shaft 506, which is the input of a gear box reducer 510. The impeller 505 rotates by the reaction of the blades to the pressure created by the flow of foam. The reducer 510 is centered in the cylindrical body 500 by mounting anchors 515. The anchors 515 are preferably evenly distributed around a plane perpendicular to the longitudinal axis of the cylindrical body 500. For example, at each 120° when there are 3 anchors, or at each 90° when there are 4 anchors. The post cross-sections have to be kept narrow to minimize the interference with the foam flow. These anchors are important to keep the impeller well centered inside the central portion 501.

The reducer 510 can be simply chosen from available gear reducers. The test model has a gear reducer made of Zytel™ from a Black and Decker™ electric screwdriver with a reduction ratio of 70 to 1. The reducer will be selected to obtain an outlet rotation preferably in the range of 20 RPM to 100 RPM. The nozzle can be made to operate at any outlet rotation speed, but very slow rotation results in improper delays between each foam delivery to a specific location allowing the foam to burn off before a subsequent application. Very fast rotation results in curving the foam stream, which limits its projected distance and thus reduces the area of coverage.

Figure 11:
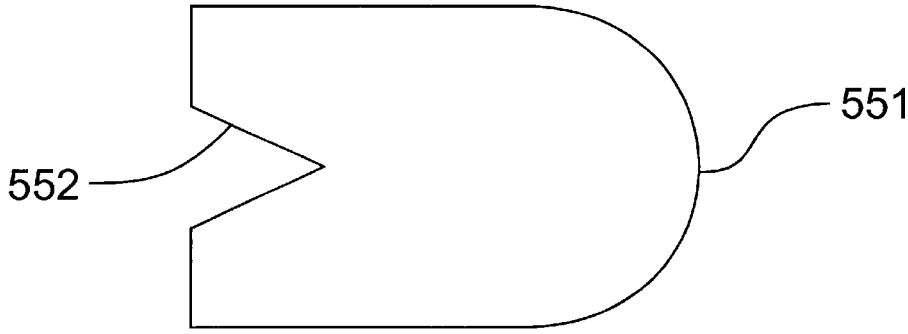
FIG. 11 is a bottom view of the eighth embodiment of the nozzle of the invention.
Figure 12:
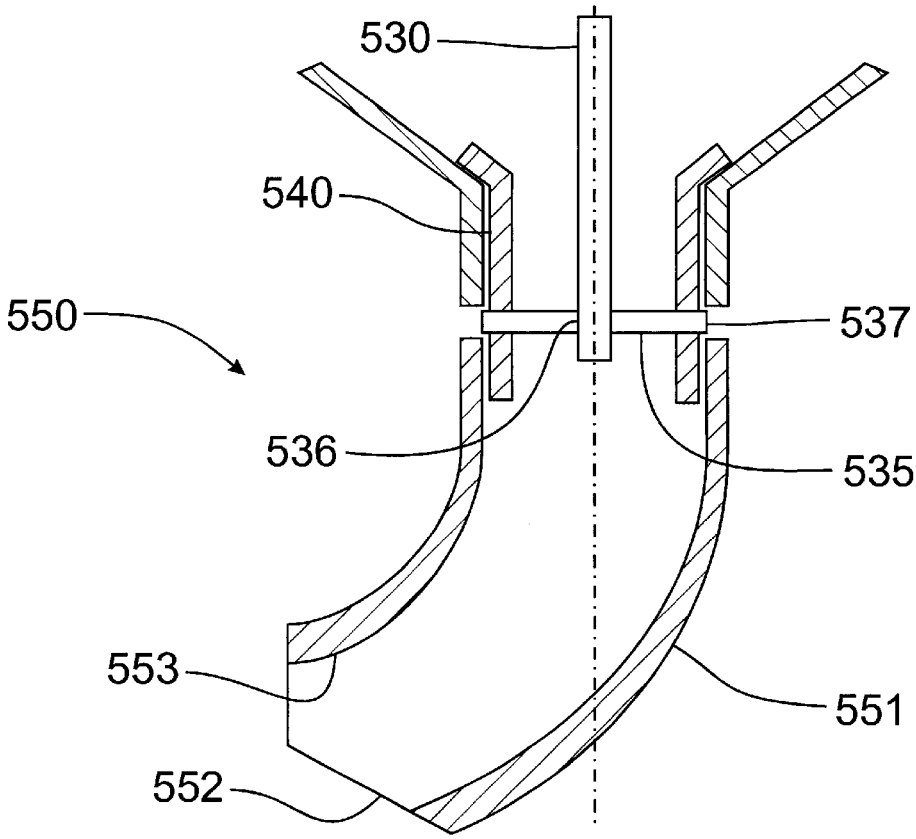
FIG. 12 is a schematic cross-section of a detail of an attachment of the eighth embodiment of the nozzle of the invention.

An output shaft 520 in alignment with, but located on the opposite end of the reducer 510 to, the impeller shaft 506, imparts rotation from the reducer to the outlet assembly 550. The outlet assembly 550 has a collar 540, an outlet anchor 527 and an outlet diffuser 551 having a notch 552. The collar 540 is a cylindrical short tube having an external diameter smaller than the nominal internal diameter of the cylindrical body 500. The anchor 527 (537 in FIG. 12) joins the output shaft 520 to the collar 540. It is possible to have a short output shaft 520, such as on FIG. 10, a long impeller shaft 536, such as on FIG. 12, or any variation between these, the shape of the anchor can vary from the curved shape 525 of FIG. 10, to the straight shape 535 of FIG. 12, to compensate the distance between the bottom of the reducer 510 to below the cylindrical body 500. The output shaft 520 (530, FIG. 12) has a hole 526 (536, FIG. 12) retaining the central portion of the anchor 525 (535, FIG. 12), while both end of the anchor are press fitted in 2 holes 527 (537, FIG. 12), aligned with the longitudinal axis of the cylindrical body 500, in the collar 540. The top portion of the collar 540 is flared to create a bearing surface sitting over the internal surface of bottom of the central portion 501. Low friction bands at the contact between these surfaces can assist in the rotation movement, but are not essential since the collar 540 is loose fitted. The bottom external portion of the collar 540 is secured to the top internal surface of the diffuser 551. Preferably, a gap is left between the cylindrical body 500 and the diffuser 551 to free a passage for the tip of the outlet anchor 527. The diffuser 551 is an elbow tube having smooth curved surfaces to project the foam outwardly. A V-shaped notch 552 (plus detail on FIG. 11) can be added to direct a portion of the foam closer to the longitudinal axis of the cylindrical body. This notch 552 reduces slightly the diameter of coverage, but assures an even distribution in the delimited area of coverage. The diffuser 551 can have a constant internal cross-section or have a slight inward slope 553 at the output end to increase the output pressure.

In operation, the compressed air foam (CAF) is formed in the pipe before entering in the nozzle. The foam is forced through the impeller 505, which reacts by rotating, and therefore drives the impeller shaft 506 of the reducer 510. The high velocity of the impeller 506 is transferred into low speed higher torque, by the reducer 510. The output shaft 520 of the reducer 510 drives the diffuser 551 having a notch 552 to project the foam homogeneously in a large circle.

Because the diffuser 551 is gear driven, this nozzle can be used as a unit in any flow direction. In the example the nozzle is shown as hanging from a ceiling, but it can easily be used upside down as a floor unit, even part of a pop-up system.

Figure 13:
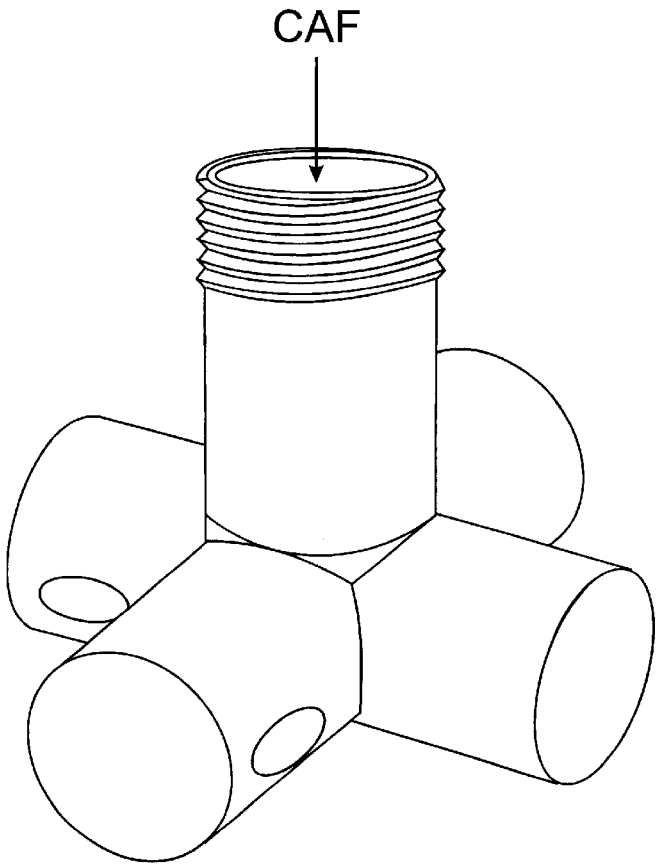
FIG. 13 is a side view of the nozzle of the invention according to any of the first to the seventh embodiment having two barrels.
Figure 14:
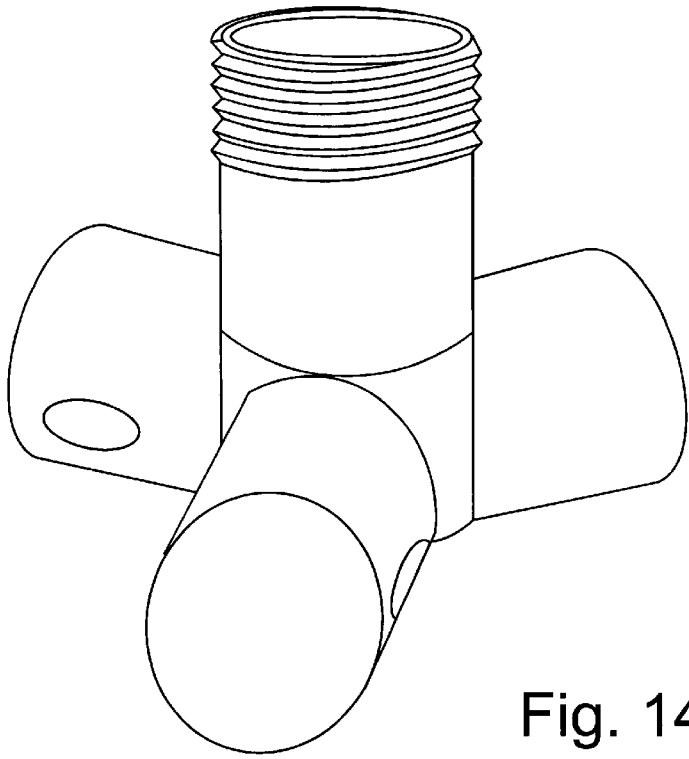
FIG. 14 is a side view of the nozzle of the invention according to any of the first to the seventh embodiment having three barrels.

All the embodiments described in the first to the seventh embodiments are shown having a barrel having two branches. Multiple branches barrel versions such as shown in FIG. 13 and 14 can also be used to deliver compressed air foam at similar or higher rate, but with slower rotation speed. Similarly the diffuser 551 of the eighth embodiment can have more than one outlet.

It is understood that the present invention is not limited to the sole embodiment described above, but encompasses any and all embodiments within the scope of the following claims.

What is claimed is:

1. A foam distribution nozzle comprising:

a supply tubing for supplying foam from a supply conduit, having a longitudinal axis;

a barrel being rotatably attached to the supply tubing and defining a passageway therein, the passageway of the barrel being at angle to the longitudinal axis of the supply tubing;

the barrel having at least one orifice which, upon forced flow of the foam, delivers a stream of the foam along a trajectory having a component that is tangential to a circular path coaxial with the longitudinal axis of the supply tubing such as to cause a rotational movement of the barrel; and a central bearing which includes a thin-shaft spindle having a first portion co-axial with the supply tubing to rotatably mount the barrel and defining an axis of rotation, and a second portion for engaging the supply tubing;

wherein the sum of all the cross-sectional areas of the at least one orifice is not less then ⅓ of the cross-section of the supply conduit, and wherein the barrel has two orifices, said orifices being disposed on opposite sides of the axis of rotation, and each orifice delivering a stream of the foam in opposite directions.

2. The foam distribution nozzle of claim 1, wherein the barrel has a third orifice adjacent to the central bearing to deliver stream of foam near the axis of rotation.

3. The foam distribution nozzle of claim 1, wherein the first portion of the central bearing is a loose fit sleeve bearing joining the spindle to the barrel.

4. The foam distribution nozzle of claim 1, wherein the first portion of the central bearing has a ball bearing joining the spindle to the barrel.

5. The foam distribution nozzle of claim 1, wherein the barrel has an intermediary conduit section in continuity, but rotatably mounted to the supply conduit, the intermediary conduit section being substantially perpendicular to the passageway.

6. The foam distribution nozzle of claim 5, where the barrel has two orifices, said orifices being disposed on opposite sides of the axis of rotation, and each orifice delivering a stream of the foam in opposite directions.

7. The foam distribution nozzle of claim 6, wherein the barrel has a third orifice adjacent to the central bearing to deliver a stream of foam near the axis of rotation.

8. The foam distribution nozzle of claim 5, wherein the barrel has two orifices of different area, said orifices being disposed on opposite sides of the axis of rotation, and each orifice delivering a stream of the foam in the same direction.

9. The foam distribution nozzle of claim 8, wherein the barrel has a third orifice adjacent to the central bearing to deliver a stream of foam near the axis of rotation.

10. The foam distribution nozzle of claim 5, wherein the barrel has deflectors to divide the flow in each upper branch of the barrel.

11. The foam distribution nozzle of claim 10, wherein the barrel has two orifices, said orifices being disposed on opposite sides of the axis of rotation, and each orifice delivering a stream of the foam in opposite directions.

12. The foam distribution nozzle of claim 10, wherein the barrel has two orifices of different area, said orifices being disposed on opposite sides of the axis of rotation, and each orifice delivering a stream of the foam in the same direction.

13. The foam distribution nozzle of claim 10, wherein the barrel has several orifices on each upper branch of the barrel.

14. The foam distribution nozzle of claim 10, wherein the orifices of one upper branch of the barrel deliver a stream of the foam in the same direction, while the orifices of the other upper branch deliver a stream of the foam in the other direction.

15. The foam distribution nozzle of claim 14, wherein at least one of the orifices is a truncated section of the tip of one upper branch.

16. The foam distribution nozzle of claim 10, wherein all the orifices deliver a stream of the foam in the same direction, provided that the sum of the areas of the orifices of one upper branch is different of this sum in the other upper branch.

17. The foam distribution nozzle of claim 16, wherein at least one of the orifices is a truncated section of the tip of one upper branch.

18. The foam distribution nozzle of claim 10, wherein the orifices are distributed randomly, provided that the sum of the areas of the orifices delivering a stream of the foam in one direction is different from the sum of the orifices delivering in the other direction.

19. The foam distribution nozzle of claim 18, wherein at least one of the orifices is a truncated section of the tip of one upper branch.

20. The foam distribution nozzle of claim 1, wherein the barrel has a plurality of branches extending in several directions, from the supply tubing longitudinal axis;

each of these branches defining a passageway and;

each branch having at least one orifice.

21. The foam distribution nozzle of claim 20, wherein the barrel has 3 branches arranged at 120° from each other.

22. The foam distribution nozzle of claim 20, wherein the barrel has 4 branches arranged at right angle from each other.

23. A foam distribution nozzle comprising:

a supply tubing for supplying foam from a supply conduit, having a longitudinal axis;

a barrel being rotatably attached to the supply tubing and defining a passageway therein, the passageway of the barrel being at angle to the longitudinal axis of the supply tubing;

the barrel having at least one orifice which, upon forced flow of the foam, delivers a stream of the foam along a trajectory having a component that is tangential to a circular path coaxial with the longitudinal axis of the supply tubing such as to cause a rotational movement of the barrel; and a central bearing which includes a thin-shaft spindle having a first portion co-axial with the supply tubing to rotatably mount the barrel and defining an axis of rotation, and a second portion for engaging the supply tubing;

and wherein the sum of all the cross-sectional areas of the at least one orifice is not less than ½ of the cross-section of the supply conduit, and wherein the barrel has two orifices, said orifices being disposed on opposite sides of the axis of rotation, and each orifice delivering a stream of the foam in opposite directions;

and wherein the barrel has two orifices of different sizes, said orifices being disposed on opposite sides of the axis of rotation, and each orifice delivering a stream of the foam in the same direction and;

wherein the barrel has a third orifice adjacent to the central bearing to deliver a stream of foam near the axis of rotation.

* * * * *